US007037240B2

(12) United States Patent
Pemberton

(10) Patent No.: US 7,037,240 B2
(45) Date of Patent: May 2, 2006

(54) METHOD AND APPARATUS FOR EXERCISING HAND

(76) Inventor: Brent D. Pemberton, 4241 E. Shangri La Rd., Phoenix, AZ (US) 85028

( * ) Notice: Subject to any disclaimer, the term of this patent is extended or adjusted under 35 U.S.C. 154(b) by 402 days.

(21) Appl. No.: 10/053,718

(22) Filed: Jan. 22, 2002

(65) Prior Publication Data

US 2003/0139257 A1 Jul. 24, 2003

(51) Int. Cl.
*A63B 23/16* (2006.01)

(52) U.S. Cl. ..... 482/49; 482/121

(58) Field of Classification Search ..... 482/49, 482/121, 128, 44, 47, 48, 50, 122, 124; 601/40
See application file for complete search history.

(56) References Cited

U.S. PATENT DOCUMENTS

| | | | | |
|---|---|---|---|---|
| 1,623,869 | A * | 4/1927 | Giraldi | 482/49 |
| 3,265,389 | A * | 8/1966 | Carlson | 482/49 |
| 4,711,445 | A * | 12/1987 | Whitehead | 482/49 |
| 4,754,963 | A * | 7/1988 | Dowd | 482/49 |
| 4,828,249 | A * | 5/1989 | Keating | 482/121 |
| 2003/0069109 | A1* | 4/2003 | Bender | 482/49 |

OTHER PUBLICATIONS

Exer-Rings, advertisement by Exerquipment Inc., The National Sports Daily, Dec. 10, 1990, p. 31.*
Sorbothane II, product brochure, 1992.*
Exer-Rings, Flaghouse Special Populations Spring 1995 catalog, p. 81.*
Benji T. Gripster, Pemberton Enterprise LLC, webpage from benjitgripster.com/aboutus Internet website, Jun. 10, 2005.*
SORBOTHANE Frequently Asked Questions (FAQ), Oct. 23, 2001.*

* cited by examiner

*Primary Examiner*—Stephen K. Cronin
*Assistant Examiner*—Victor K. Hwang
(74) *Attorney, Agent, or Firm*—Tod R. Nissle, P.C.

(57) ABSTRACT

A method and apparatus are provided for exercising a hand. A doughnut-shaped elastomer is provided. The elastomer is held with the bottom portion nested in the bottom of the palm of the hand and with the top portion gripped by the four fingers of the hand. As the fingers squeeze the elastomer, the top portion of the elastomer rolls or twists while the bottom portion of the elastomer remains stationary in the palm of the hand. The twisting of the top portion causes the elastomer to bow or arch into the hand, supporting the hand and generating a comfortable sensation in the hand while the elastomer is compressed with the fingers.

6 Claims, 3 Drawing Sheets

METHOD AND APPARATUS FOR EXERCISING HAND

This invention relates to exercise apparatus.

More particularly, the invention relates to a method for exercising the hand by utilizing an elastic exercise device which is grasped in the hand and which, when compressed by the hand, elastically rotates and conforms to and supports the hand to produce a comfortable sensation in the hand while the hand compresses the elastic exercise device.

Many devices for exercising the hands and other parts of the body are known in the art. One well known apparatus for exercising the hands comprises a spring. The spring includes a pair of arm which each extend from one end of the spring to form cooperatively a V-shape. Each arm is provided with a cylindrical handle. The handles are grasped between the fingers and palm of the hand and are compressed toward one another to exercise the hand. The spring resists the compression of the handles. One disadvantage of this apparatus is that the handles typically comprise a hard plastic or other hard material and are not particularly comfortable to the hand when the handles are displaced toward one another.

Therefore, it is a principal object of the instant invention to provide an improved method and apparatus for exercising the hand.

Another object of the invention is to provide an improved exercise apparatus and method which is comfortable to an individual's hand while the apparatus is being utilized to exercise the hand.

These, and other and further and more specific objects of the invention will be apparent to those skilled in the art based on the following description, taken in conjunction with the drawings, in which.

Briefly, in accordance with the invention, I provide an improved method for exercising a hand. The hand includes fingers and a palm. The improved method includes the steps of providing a doughnut-shaped, compressible, elastic exercise apparatus, the exercise apparatus having a durometer which permits one portion of the apparatus to be elastically rotated and strained by the fingers while another portion of the apparatus is stationary; grasping the exercise apparatus in the hand between the fingers and palm such that a first portion of the apparatus is grasped by the fingers and a second portion of the apparatus nests in the palm of the hand; using the fingers to simultaneously displace the first portion toward the second portion, and rotate the first portion while the second portion generally remains nested in and is prevented from rotating by the palm.

Figure 1:
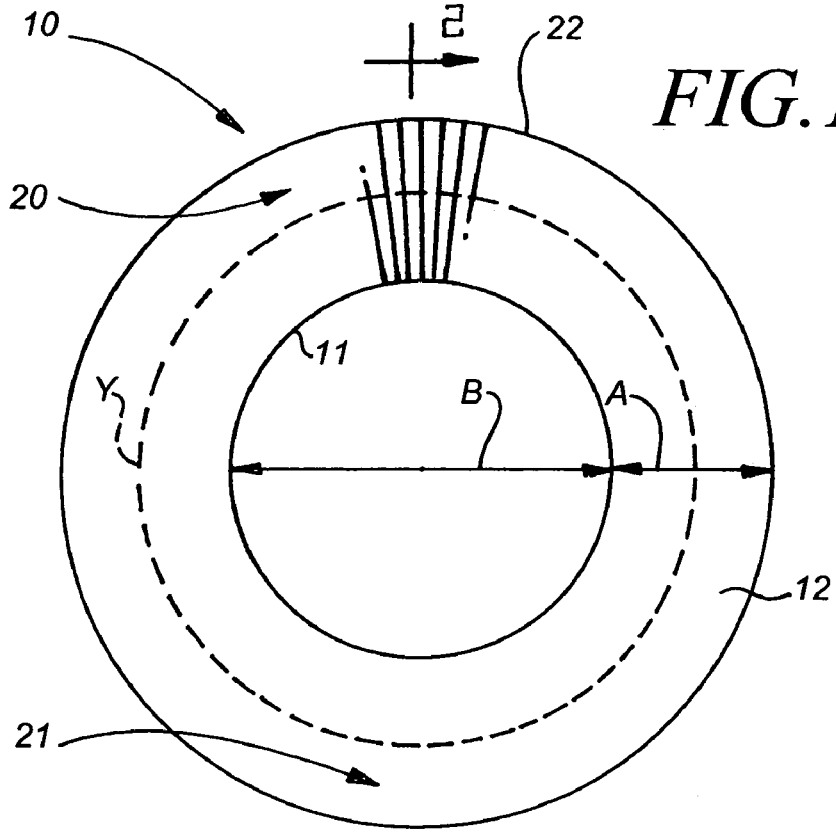
FIG. 1 is a front elevation view illustrating exercise apparatus constructed in accordance with the principles of the invention.
Figure 2:
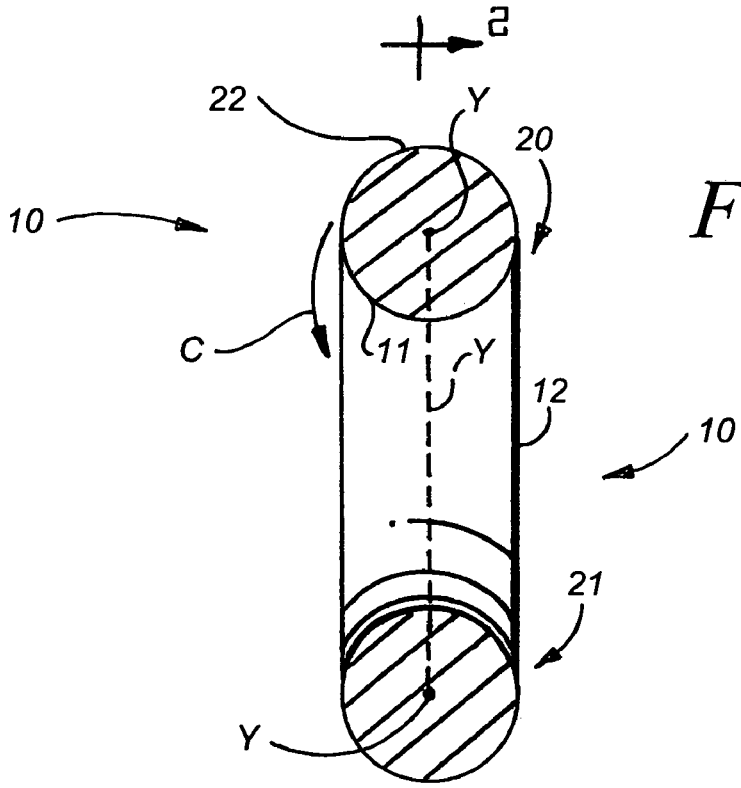
FIG. 2 is a section view illustrating further construction details of the exercise apparatus of FIG. 1 and taken along section line 2—2 thereof.

Turning now to the drawings, which illustrate the presently preferred embodiments of the invention for the purpose of describing the operation and use thereof and not by way of limitation of the scope of the invention, and in which like reference characters refer to corresponding elements throughout the several views, FIG. 1 is a doughnut-shaped apparatus 10 including an upper portion 20 and a lower portion 21. While the diameter or width A can vary as desired, diameter A is presently in the range of about ⅞ inch plus or minus ¼ inch for apparatus 10 utilized by an adult. In FIGS. 1 and 2, the diameter A is constant along the length of apparatus 10. This is not necessary and the diameter A can, if desired, vary at different points along the length of doughnut-shaped apparatus 10. The diameter B of the opening 11 through the center of apparatus 10 can vary as desired, but for apparatus utilized by an adult is preferably in the range of 1 and ⅞ inches (1.875 inches) plus or minus ¼ inch. Opening 11 is important in the practice of the invention because it is desirable that portion 20 can be readily displaced (compressed) toward portion 21 when the apparatus 10 is being compressed between the fingers and palm of a hand. Doughnut-shaped apparatus 10 is sized so it can be held in the hand of a user in the manner illustrated in FIG. 3. When portion 20 is displaced (compressed) toward portion 21, the circular cross-sectional area of portion 21 preferably, but not necessarily, remains about the same and is, if at all, reduced by less than 20%, preferably less than 5%. In addition, the shape of the cross-sectional area of portion 21 generally, but not necessarily, remains circular as indicated in FIG. 4.

As used herein, compression or compressibility indicates the distance upper portion 20 is displaced toward lower portion 21 when the fingers 31, 32 apply to portion 20 a given displacement or squeezing force in the direction of arrow V. In contrast, compression does not indicate how much portion 20 itself is squeezed or compressed to change the shape and dimension of portion 20.

As used herein, elastic compression indicates that portion 21—or some other portion of apparatus 10—returns to its original shape, position, and/or orientation after being compressed and then released.

As used herein, strain indicates the deformation of apparatus 10 from its "at rest" shape shown in FIGS. 1 and 2 when external forces are applied to apparatus 10 by the fingers and/or thumb of a hand 30.

As used herein, elastic strain indicates that the deformation of apparatus 10 is elastic because after apparatus 10 is deformed and the external forces causing the deformation are removed, apparatus 10 returns to its normal "at rest" shape shown in FIGS. 1 and 2.

As used herein, rotation of apparatus 10 indicates the twisting of a portion 20 of apparatus 10, such twisting being caused by external forces and generally occurring about a portion of the circular center line Y that extends through the center of the arcuate cylindrical member comprising apparatus 10.

As used herein, elastic rotation indicates that the twisting of apparatus 10 is elastic because after apparatus 10 is twisted and the external forces causing the twisting are removed, apparatus 10 returns to its normal "at rest" shape shown in FIGS. 1 and 2 As used herein, the modulus of elasticity is the ratio of stress to strain in apparatus 10.

As used herein, deformability indicates the distance a portion 20 of or a point X on apparatus 10 is displaced when an external force(s) of a given magnitude is applied at a given point(s) to apparatus 10. For example, portion 20 is displaced a certain distance toward portion 21 when fingers 31, 32 apply in the direction of arrow V (FIG. 4) a force having a certain magnitude. Or, point X (FIG. 3) is displaced a certain distance to the position shown in FIG. 4 when fingers 31, 32 apply in the direction of arrow D a twisting or rotational force having a certain magnitude.

Rubber, plastic, or any other desired elastomer can be utilized to fabricate apparatus 10. The durometer of apparatus 10 can vary as desired but is preferably in the range of 30 to 50 Shore A when apparatus 10 is to be utilized by an adult. The deformability and durometer of apparatus should permit apparatus 10 to be grasped in the manner shown in FIG. 3 and to be elastically compressed and rotated in the manner illustrated in FIG. 4 and described in more detail below. If the durometer is in excess of 50, it begins to be difficult to rotate a portion of apparatus 10. If the durometer is less than 30, apparatus 10 is, by an adult, rotated so easily that the benefit obtained from exercising with apparatus 10 is minimal. However, for children or adults who are rehabilitating or have unusually weak hands, a durometer less than 30 (possibly down to a durometer of 10) may be desirable. Apparatus 10 is presently fabricated from natural "pure gum" rubber having a durometer of forty plus or minus five, a tensile strength of about 2700 psi, and an elongation of about 600% (before tearing).

Durometer often appears to correlate directly with deformability, i.e., as the durometer (hardness) increases, the deformablity generally, but not always, decreases. It is possible for the durometer to increase a certain amount without a reduction in the deformability of an elastomer.

Figure 3:
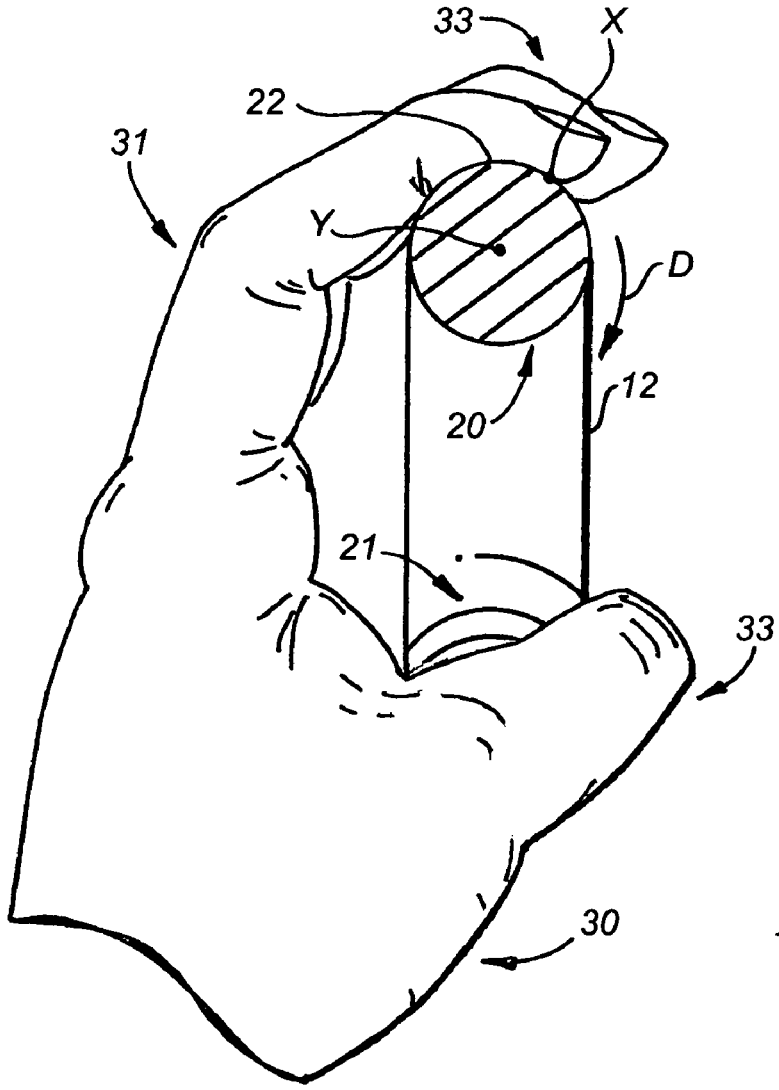
FIG. 3 is side elevation view illustrating the mode of operation of the exercise apparatus of the invention; and, FIG. 4 is a side elevation view further illustrating the mode of operation of the exercise apparatus of the invention.
Figure 4:
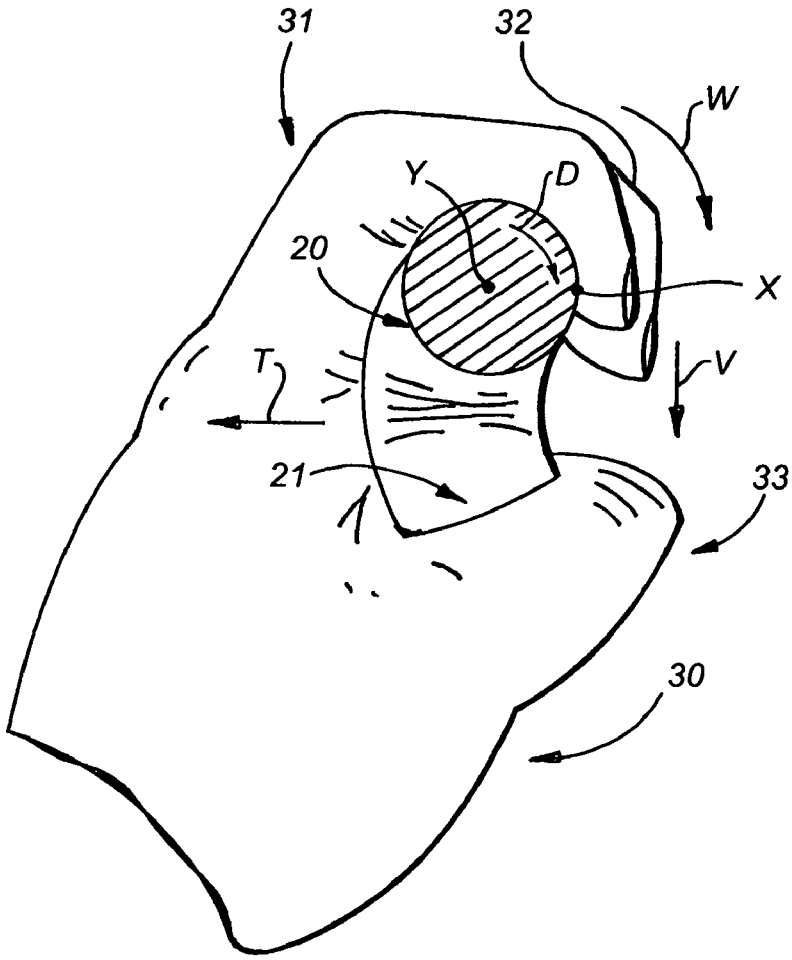

In use, apparatus 10 is grasped in the manner shown in FIG. 3, between the fingers 31, 32 and lower palm of a hand 30. Thumb 33 can wrap around the front of apparatus 10 in the manner shown in FIG. 3, or can extend outwardly away from apparatus 10 such that apparatus 10 nests solely in the lower palm and between fingers 31 and 32 and the palm. In FIGS. 3 and 4, only the index 31 and middle 32 fingers are visible. The remaining two fingers (the third finger and the little finger) normally also grasp the upper portion 20 of apparatus 10 in a manner similar to that of fingers 31, 32. Apparatus 10 can, as desired, be grasped by one or more fingers 31, 32. The lower portion 21 of apparatus 10 is seated in the lower palm in the manner illustrated in FIG. 3.

In FIGS. 1, 2 and 3, apparatus 10 is in its normal generally circular "at rest" configuration and has not been elastically compressed or deformed.

Hand 30 is exercised by displacing fingers 31, 32 toward the palm in the direction of arrow V while simultaneously rotating upper portion 20 in the direction of arrow D and compressing upper portion 20 toward lower portion 21 in the direction of arrow V. When fingers 31, 32 rotate upper portion 20 in the direction of arrow D, fingers 31, 32 normally rotate simultaneously with portion 20 in the manner indicated by arrow W in FIG. 4, such that the portion of finger 31 contacting point X on apparatus 10 continues to contact point X while fingers 31, 32 rotate portion 20 in the direction of arrow D. The rotation and compression of upper portion 20 causes apparatus 10 to bow, or arch, in the direction of arrow T and to contour into the upper palm and the lower portions of fingers 31, 32. This bowing action provides support for the upper palm and the lower portions of fingers 31, 32 and, consequently, typically makes use of apparatus 10 unusually comfortable to the hand 30. When apparatus 10 is compressed in the manner shown in FIG. 4, apparatus 10 loses its circular doughnut shape and takes on a shape which is more oblong or elliptical. When fingers 31, 32 are opened, apparatus 10 is released and elastically returns to the shape illustrated in FIGS. 1 and 2.

Having described my invention in such terms as to enable those of skill in the art to make and use the invention, and having described the presently preferred embodiments and best mode thereof.

The invention claimed is:

1. A method of exercising a hand, said hand including fingers and a palm, said method including the steps of:

(a) providing a doughnut-shaped, compressible, elastic exercise apparatus, said exercise apparatus having a generally circular center line Y and a deformability which permits one portion of the apparatus to be rotated by the fingers while another portion of the apparatus is stationary, wherein said exercise apparatus includes a central opening having a diameter in the range of one and five-eighths inches to two and one-eighth inches, and a generally circular elastic ring circumscribing said opening and having a circular cross-sectional with a diameter in the range of five-eighths to nine-eighths of an inch, and has a durometer in the range of 30 to 50 Shore A;

(b) grasping the exercise apparatus in the hand between the fingers and palm such that a first portion of the apparatus having a generally circular cross-section area is grasped by the fingers and a second portion of the apparatus nests in the palm of the hand; and (c) moving the fingers to simultaneously (i) displace said first portion toward said second portion, and (ii) elastically rotate and twist said first portion about said centerline Y while said second portion generally remains nested in and is prevented from rotating by the palm, and said cross-sectional area is reduced by less than 20% during step (c).

2. The method of claim 1 wherein said cross-sectional area is reduced by less than 5% during step (c).

3. The method of claim 1 wherein said exercise apparatus is fabricated from rubber.

4. A method of exercising a hand, said hand including fingers and a palm, said palm including an upper portion, each of said fingers including a lower portion, said method comprising the steps of:

(a) providing a doughnut-shaped, compressible, elastic exercise apparatus, said exercise apparatus having a generally circular center line Y and a deformability which permits (i) one portion of the apparatus to be rotated by the fingers while another portion of the apparatus is stationary, and (ii) said apparatus to arch elastically into the upper portion of the palm and the lower portion of each of the finger, wherein said exercise apparatus includes a central opening having a diameter in the range of one and five-eights inches to two and one-eight inches, and a generally circular elastic ring circumscribing said opening and having a circular cross-section with a diameter in the range of five-eights to nine-eighths of an inch, and has a durometer in the range of 30 to 50 Shore A;

(b) grasping the exercise apparatus in the hand between the fingers and palm such that a first portion of the apparatus having a generally circular cross-section area is grasped by the fingers and a second portion of the apparatus nest in the palm of the hand;

(c) moving the fingers to simultaneously (i) displace said first portion toward said second portion, (ii) elastically rotate and twist said first portion about said center Y while said second portion generally remains nested in and is prevented from rotating by the palm, and (iii) cause said apparatus to elastically arch into the upper portion of the palm and the lower portion of each of the fingers, and said cross-sectional area is reduced by less than 20% during step (c).

5. The method of claim 1 wherein said cross-sectional area is reduced by less than 5% during step (c).

6. The method of claim 4 wherein said exercise apparatus is fabricated from rubber.

* * * * *